US006547164B2

(12) United States Patent
Miquel et al.

(10) Patent No.: US 6,547,164 B2
(45) Date of Patent: Apr. 15, 2003

(54) VAPOR-LIQUID EJECTOR WITH A REMOVABLE NOZZLE

(75) Inventors: Pierre Miquel, Bourg la Reine (FR); François Poncelet, Le Vesinet (FR); Philippe Bretault, Voisins-le-Bretonneux (FR); Didier Michel, Sonchamp (FR)

(73) Assignee: Compagnie Generale des Matieres Nucleaires, Velizy-Villacoublay (FR)

( * ) Notice: Subject to any disclaimer, the term of this patent is extended or adjusted under 35 U.S.C. 154(b) by 136 days.

(21) Appl. No.: 09/799,137

(22) Filed: Mar. 5, 2001

(65) Prior Publication Data

US 2001/0020649 A1 Sep. 13, 2001

(30) Foreign Application Priority Data

Mar. 10, 2000 (FR) ..... 00 03104

(51) Int. Cl.[7] ..... B05B 7/06
(52) U.S. Cl. ..... 239/432; 239/434
(58) Field of Search ..... 239/432, 433, 239/434, 337, 340, 341, 344, 346

(56) References Cited

U.S. PATENT DOCUMENTS

| | | | | |
|---|---|---|---|---|
| 2,642,813 A | | 6/1953 | Woodruff et al. | |
| 3,494,559 A | * | 2/1970 | Skinner | 239/14.2 |
| 4,066,385 A | | 1/1978 | Diebold | |
| 4,165,834 A | * | 8/1979 | Pitchon et al. | 111/200 |
| 4,184,806 A | | 1/1980 | Prinz | |

FOREIGN PATENT DOCUMENTS

| | | | |
|---|---|---|---|
| FR | 2 384 140 | 3/1977 | F04F/5/14 |
| FR | 2 617 245 | 12/1988 | F04F/5/46 |
| GB | 505287 | 5/1939 | |
| WO | WO 89/07491 * | 8/1989 | |

OTHER PUBLICATIONS

French Preliminary Search Report in French, with annex, dated Nov. 9, 2000, 2 pp.

* cited by examiner

*Primary Examiner*—Lisa A. Douglas
(74) *Attorney, Agent, or Firm*—Cohen, Pontani, Lieberman & Pavane

(57) ABSTRACT

The present invention provides a vapor-liquid (V-L) ejector with a removable nozzle (2) in which the internal structure has been modified and improved concerning the clearance that exists to enable said nozzle (2) to be engaged in the body (10) of said ejector (1). The invention also provides a nozzle (2) for such an ejector (1).

22 Claims, 3 Drawing Sheets

VAPOR-LIQUID EJECTOR WITH A REMOVABLE NOZZLE

The present invention relates to a vapor-liquid ejector with a nozzle that is removable (or dismountable).

BACKGROUND OF THE INVENTION

This type of device is known per se. It enables a liquid to be entrained by means of a driving fluid: namely the vapor. Said vapor passes through the nozzle of the device which transforms its pressure into speed. The nozzle is usually of the "supersonic" type having a converging-diverging profile which serves to increase outlet speed compared with that which would be obtained using a converging-only nozzle. Optimum efficiency is obtained by bringing the pressure of the vapor close to the suction pressure of the liquid. On coming into contact with the driven liquid, the vapor condenses very quickly, but not instantly. There generally remains a "dart" of vapor in the form of a converging cone at the outlet from the nozzle.

The driving fluid is generally steam, but there is no a priori reason why some other kind of vapor should not be used, providing its physical conditions are suitable and it does not pollute the driven liquid.

Whatever the kind of vapor used, the ejector nozzle which is engaged removably in the body of said ejector is raised to a relatively high temperature because of the flow of said vapor through the nozzle, thus making it a part which is sensitive to attack by corrosion. This problem is particularly applicable to the portion of the nozzle which is in contact with the driven liquid.

In any event, the problem of corrosion is critical in the clearance that must be present in order to enable the removable nozzle to be engaged in the body of the ejector, which clearance is accessible to the driven liquid and, with reference to said liquid, constitutes a kind of dead zone.

Crevice corrosion inevitably develops in said clearance.

OBJECTS AND SUMMARY OF THE INVENTION

The present invention has been developed with reference to this problem of corrosion in the structure of vapor-liquid ejectors having removable nozzles.

To make the invention easier to describe and also easier to understand, the present description begins with reference to the accompanying FIG. 1 by describing the structure of prior art removable-nozzle vapor-liquid ejectors. On sight of said structure, the above-mentioned corrosion problem can easily be understood. With respect to said problem, the present invention proposes an improvement to the structure of such prior art removable-nozzle vapor-liquid ejectors.

As shown in section in FIG. 1, the body 10 of such a prior art ejector 1 (and more precisely a recess 14 in said body 10) contains a nozzle 2 which is removably engaged therein. Said body 10 is provided:

- with a first duct 11 for feeding said nozzle 2 with vapor V, i.e. the driving fluid; and
- with a second duct 12 downstream from the first duct 11 along the axis of said nozzle 2 and relative to the flow direction of said vapor V, for the purpose of introducing the driven liquid L into said body 10.

Said nozzle 2 is positioned in stable manner in the recess 14 of said body 10, coming into abutment against an internal shoulder 13 of said body 10. A shoulder 3 of said nozzle 2 co-operates with said shoulder 13.

Sealing means 9 are located at the facing surfaces of said shoulders 3 and 13, i.e. the surfaces 3' and 13', which sealing means are for preventing the liquid L that is driven through the duct 12 from rising further upstream.

The sealing means 9 define two zones 14' and 14" in the recess 14 of said body 10 of the ejector 1:

- an upstream zone 14' which, in theory, is not accessible to the liquid L; and
- a downstream zone 14" which is accessible to the liquid L, which zone begins with an interstitial volume v which is generally annular insofar as said recess 14 and said nozzle 2 (over a fraction of its length) are generally cylindrical in shape. This volume corresponds to clearance enabling the nozzle 2 to be assembled in the recess 14 in the body 10 of the ejector 1. This clearance is provided between the outside surface 4 of the body of the nozzle 2 where it extends downstream from the shoulder 3 of said body of said nozzle 2, and the surface 13" of the inner shoulder 13 of the body 10 of the ejector 1 which faces said outer surface 4 of the body of said nozzle 2. The volume extends along the axis of said nozzle 2 over a length that goes from said shoulder 3 of said body of the nozzle 2 (the sealing means 9) to level with the location where said driven liquid L is introduced via the second duct 12 into the downstream zone 14" of the recess 14 in the body 10 of the ejector 1 (the arrival zone of said liquid L).

On observing FIG. 1 and on reading the above, the person skilled in the art will already have understood that the above-mentioned corrosion is critical in said interstitial volume v where the driven liquid L is heated by coming into contact with the outer surface 4 of the nozzle 2 and where it tends to stagnate. In prior art ejector structures, this volume v generally has a thickness e that is constant and equal to about 0.2 millimeters (mm).

In the invention, it is proposed to modify the internal structure of such ejectors in order to minimize corrosion problems in said volume v.

It has been found that two types of modification are necessary to obtain the desired effect (to transform said volume v from a dead zone to a genuinely dynamic zone):

- said volume v must be enlarged; and
- means must act to ensure that said enlarged volume v is swept by (non-stagnant) liquid;

surprisingly, it has been found that these modifications do not significantly degrade the hydraulic performance of the ejector in question.

The main object of the present invention is thus to provide a novel removable-nozzle vapor-liquid ejector of the type shown in accompanying FIG. 1 and modified in the manner outlined above.

Said novel ejectors thus comprise in conventional manner a body having a recess that receives a removable nozzle, said body of said ejector presenting:

- a first duct for feeding said nozzle with vapor;
- a second duct downstream from said first duct along the axis of said nozzle relative to the flow direction of said vapor and serving to introduce the driven liquid into said recess of said body; and
- between said first and second ducts, an internal shoulder against which a shoulder of the body of said nozzle comes into abutment, sealing means being interposed between the facing surfaces of said two shoulders to prevent the driven liquid rising upstream from said sealing means; a (generally annular) interstitial volume inherent to said engagement then existing between the outer surface of the body of said nozzle where it extends downstream from the shoulder of said body of said nozzle and the surface of the internal shoulder of the body of the ejector facing said outer surface of the body of said nozzle, said (generally annular) interstitial volume extending along the axis of said nozzle over a length that goes from the shoulder of said body of said nozzle to the level where the driven liquid is introduced into said body of said ejector via the second duct and giving said driven liquid access to said sealing means.

In novel manner, said ejectors of the present invention present within the above-specified conventional structure, the following two characteristics:

said (generally annular) interstitial volume has a thickness of at least 2 mm over its entire length developed along the axis of the nozzle; and on its outside surface, said nozzle has means facing said second duct that are suitable for directing at least a fraction of the driven liquid flow towards the sealing means via said (generally annular) interstitial volume.

These two characteristics in combination make it possible to achieve the desired result, i.e. to minimize corrosion in said (generally annular) interstitial volume by ensuring that the liquid genuinely flows within said volume with this flow of said liquid generally giving rise to significant cooling of said zone.

The thickness $e \geqq 2$ mm of said volume can be constant or otherwise along its length. Advantageously, it is not constant. It can vary continuously or discontinuously. Advantageously, it varies continuously (without any edge at a step). Whichever variant is used, it is advantageously larger downstream than upstream (i.e. larger at the downstream end of said volume via which the driven liquid enters and leaves said volume than at the level of the sealing means).

Said volume may or not be symmetrical.

In a particularly advantageous variant, the (generally annular) interstitial volume is of thickness that is not constant, said thickness increasing progressively from downstream to upstream over at least a fraction of its length, and preferably over its entire length. In this advantageous variant, there is thus a thickness of at least 2 mm at the level of the sealing means at the upstream end of said interstitial volume, and a thickness of more than 2 mm over at least a fraction of the length of said volume, which thickness is at a maximum at the downstream end of said interstitial volume, with the driven liquid penetrating into said volume (and leaving said volume) via said downstream end.

The person skilled in the art will have understood that the "enlarged" interstitial volume can be implemented in various shapes.

Clearly the shape of the interstitial volume depends on the shapes of the facing surfaces that define it: the outer surface of the nozzle immediately downstream from the sealing means and the facing inner surface of the recess in the body of the ejector.

To ensure that said volume is of thickness that is not constant and that increases going from upstream towards downstream over at least a fraction of its length, it is strongly recommended to use one and/or the other of the following two techniques.

Firstly, the outer surface of the body of the nozzle, extending downstream from the shoulder of said body (in the portion which is accessible to the liquid in the recess in the body of the ejector), corresponds to the shape of a truncated cone over at least the downstream fraction of the length of the interstitial volume, and advantageously over its entire length. The base of said cone is naturally located upstream. The angle of inclination (from upstream to downstream) of said outer surface of the body of said nozzle relative to the axis of said nozzle generally lies in the range 3° to 7°, and is advantageously at least 5°. It will be understood that the greater said angle, the greater the extent to which the corresponding interstitial volume is open.

Secondly, in order to open said volume, it is recommended to take action in the opposite direction on the inclination (relative to the axis of said nozzle) on the surface facing the outer surface of the body of the nozzle: the surface of the inner shoulder of the body of the ejector. With this second technique, said surface of the inner shoulder of the body of the ejector facing said outer surface of the body of the nozzle (immediately downstream from the sealing means, in the interstitial volume) flares from upstream to downstream relative to the axis of the nozzle over at least the downstream fraction of the length of the interstitial volume and advantageously over its entire length. The flare angle is advantageously less than or equal to 5° (its angle of inclination relative to the axis of the nozzle).

It will naturally be understood that in order to obtain maximum opening of the interstitial volume, it is advantageous to combine the two above techniques by inclining both facing surfaces in opposite directions.

In a particularly preferred variant, the interstitial volume is enlarged as follows:

said outer surface of the body of said nozzle extending downstream from the shoulder of said body corresponds over its entire length to the surface of a truncated cone that slopes relative to the axis of said nozzle from upstream to downstream at an angle that is advantageously at least 5°; while the surface of said internal shoulder of the body of the ejector facing said outer surface of the body of said nozzle extends from upstream to downstream over a downstream major fraction (advantageously over more than two-thirds) of the length of said interstitial volume flaring relative to the axis of said nozzle at an angle that is advantageously less than or equal to 5° (measured relative to said axis).

Insofar as the parts concerned are generally cylindrical, with a cylindrical ejector having a cylindrical recess formed in its body to receive a nozzle that is cylindrical at least in its portion upstream from the sealing means therein with clearance, it will be understood that the interstitial volume corresponding to said clearance is generally of the annular type and, given the comments made above relating to its thickness which advantageously increases continuously from upstream to downstream, it is advantageously tubular in shape being defined by two coaxial frustoconical surfaces.

Concerning the means arranged in characteristic manner on the outer surface of the nozzle in order to direct the driven liquid into the "enlarged" interstitial volume, these can exist in various forms. These means can be referred to as "deflectors".

They can be provided in particular in one or other of the following variants, namely:

they can be machined directly in the material forming said nozzle; and/or they can be separate pieces fitted to the outer surface of said nozzle.

In the first case, they can be recessed portions such as channels or grooves formed in the body of said nozzle or else they can be portions in relief forming projections.

In the second case, an additional piece is secured to the outside surface of said nozzle which is equivalent to making portions in relief in the first case.

Said means arranged on the outer surface of the nozzle in order to direct the driven liquid into the enlarged interstitial volume, whether they be additional pieces fitted on said nozzle or shapes machined in its material, can comprise in position at least one washer portion (secured to said outer surface of said nozzle) having its bottom portion situated on the axis of the second duct (through which the driven liquid arrives) and having its top portion close to the inlet to the interstitial volume. "Top" and "bottom" are used herein on the understanding that the liquid is generally moving upwards on entering the ejector. In any event, the washer or washer portion acts to deflect the liquid into the interstitial volume.

In such a variant, said means advantageously consist in:

an elliptical washer (sloping relative to the axis of the nozzle so as to present top and bottom portions as mentioned above); or an open washer (sloping relative to the axis of the nozzle so as likewise to present top and bottom portions as specified above; amounting to part of an elliptical washer), with the bottom edge of the opening being extended along the axis of the nozzle at the level of said axis by a rib extending itself towards the sealing means at the upstream end of the enlarged interstitial volume (although without touching said end). Said washer advantageously projects at 90° to the outer surface of the nozzle.

This latter embodiment of the means arranged on the outer surface of the nozzle to deflect the driven liquid into the enlarged interstitial volume (whether the means are fitted or machined in the mass of the nozzle) is particularly preferred. It makes it possible to have full control over the flow of liquid into said interstitial volume and within it, and it ensures a significant decrease in the temperature within said volume.

It operates as follows. A fraction of the flow of liquid entering via the second duct is channeled by the action of the rib. Turning motion is imparted to the liquid towards and into the (generally annular) interstitial volume between the nozzle and the body of the ejector. At the end of this turning movement (sweeping said interstitial volume), the liquid in question leaves via the opening in the washer and rejoins the flow of liquid that is driven directly.

The person skilled in the art will readily understand that other variants of the means concerned will enable the same result or an equivalent result to be obtained in equally advantageous manner.

Specifically, the person skilled in the art will understand that ejectors of the invention can exist in a wide variety of variants: the "enlarged" interstitial volume can have a variety of shapes and likewise the "deflectors" on the engaged nozzle can have a variety of shapes.

Naturally, when the deflectors operate in relief it is necessary to ensure that they do not prevent the nozzle being installed (on engagement) and that they do not prevent the nozzle being removed from the body of the ejector. They must be dimensioned appropriately.

In another aspect, the present invention provides a nozzle for constituting the removable nozzle of a vapor-liquid ejector of the invention, as described above. In characteristic manner, the outer surface of the nozzle has means, recessed or in relief, suitable for directing upstream at least a fraction of the liquid flow that is driven by the ejector in which said nozzle is to be mounted.

Said means, as described above and advantageously constituting an open washer with a rib can either be machined in the mass of said nozzle or else they can be constituted by one or more pieces added thereto.

In a preferred embodiment, the nozzle in question has a converging-diverging profile and said means are positioned on the outer surface of the converging portion of said nozzle.

It is observed at this point that in general the profile of the nozzle in an ejector structure of the invention is advantageously converging-diverging.

The use of ejectors of the invention is particularly recommended when transferring "corrosive" liquids, e.g. suspensions of acids charged with particles. Such ejectors of the invention turn out to withstand corrosion much better than prior art ejectors. The Applicant particularly recommends use of such ejectors for transferring radioactive liquids, with the ejector being mounted through the wall of an active cell.

BRIEF DESCRIPTION OF THE DRAWINGS

The accompanying figures illustrate the context of the present invention and said invention itself.

MORE DETAILED DESCRIPTION

Figure 1:
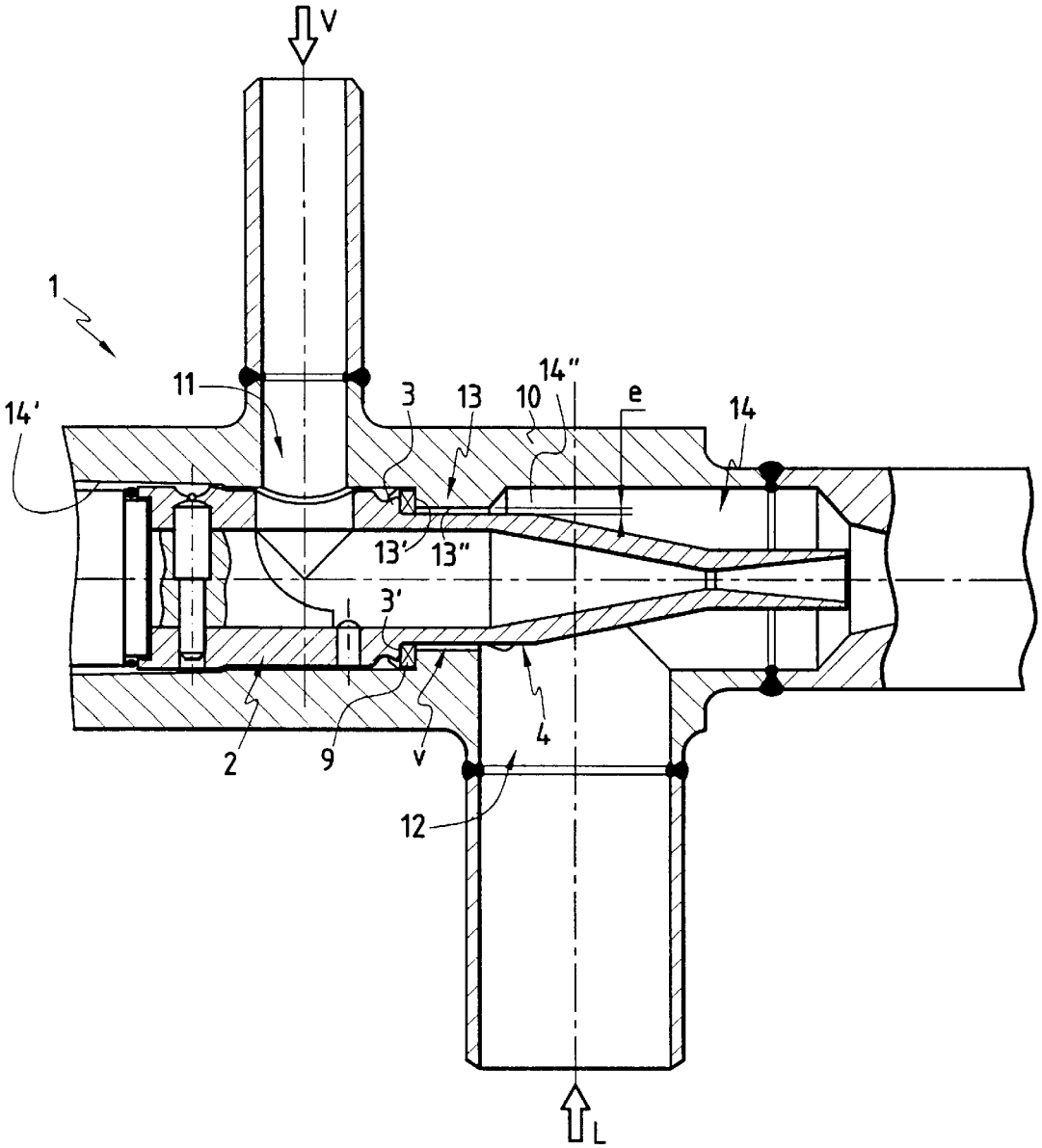
FIG.1 PRIOR ART
FIG. 1 is a diagrammatic section through a prior art vapor-liquid ejector having a removable nozzle.

FIG. 1 is described in the introductory portion of the present description. It shows a prior art removable-nozzle vapor-liquid ejector. Said nozzle 2 is shown mounted in the recess 14 of the body 10 of the ejector. The annular interstitial volume v corresponding to the clearance for assembling said nozzle 2 in said recess 14 is very narrow. It is of constant thickness e generally of about 0.2 mm.

Figure 2:
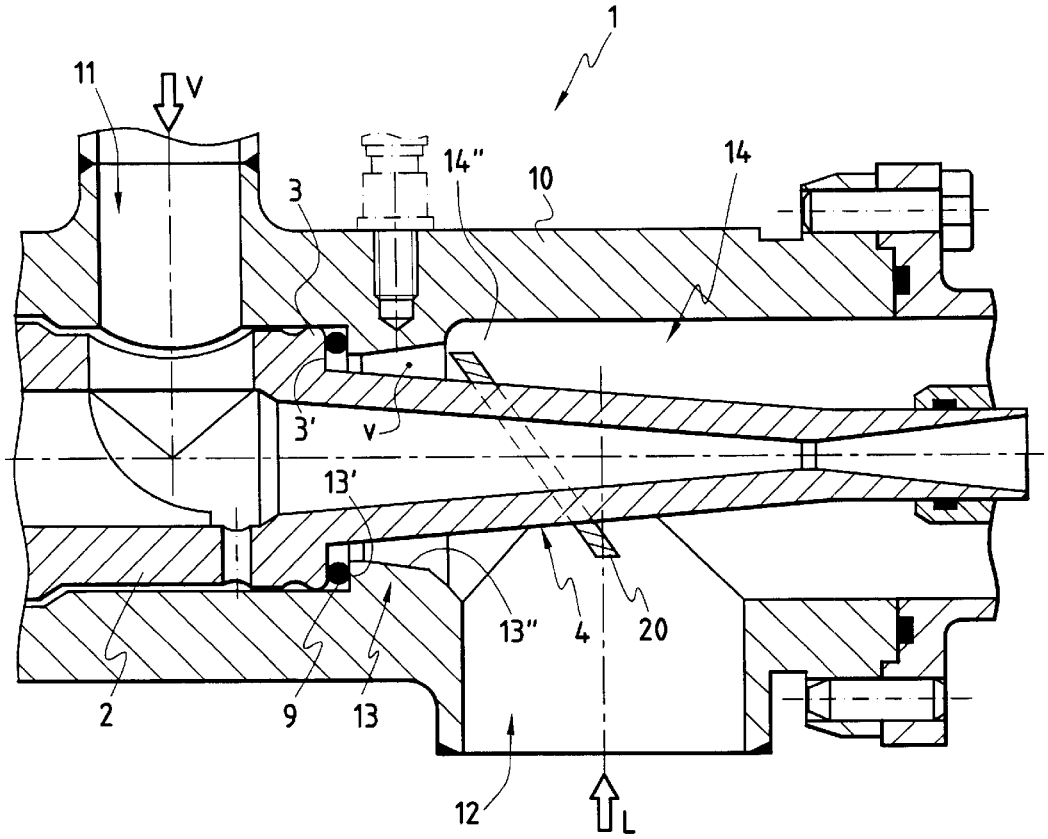
FIG. 2 is an analogous diagrammatic section through a vapor-liquid ejector of the invention, and having a removable nozzle.

In FIG. 2, the same references are used to designate the same parts and components that are common to the prior art ejector (as shown in FIG. 1) and the ejector of the invention.

With reference to FIG. 2, it can be seen that the looked-for result of the invention is obtained:

by modifying the profile of the outer surface 4 of the nozzle 2 and the profile of the shoulder 13 of the body 10; and by adding an elliptical washer 20 on said outer surface 4 of said nozzle 2.

The volume v as enlarged in this way is substantially in the form of a flared tube (being defined by two coaxial frustoconical surfaces). The outer surface 4 of the nozzle 2 slopes over the entire length of said volume v while the surface 13" of the shoulder 13 slopes in the opposite direction over the downstream major fraction thereof (but not over its entire length).

The washer 20 has been welded to said outer surface 4 of the nozzle 2 at an appropriate location (so as to face the inlet duct 12 for the liquid L) and at an appropriate angle (so as to direct a fraction of the flow of said liquid L towards the sealing means 9 via the interstitial volume v). Said washer 20 ensures that a significant quantity of liquid L penetrates into said volume v which has been made to be relatively accessible.

Figure 3:
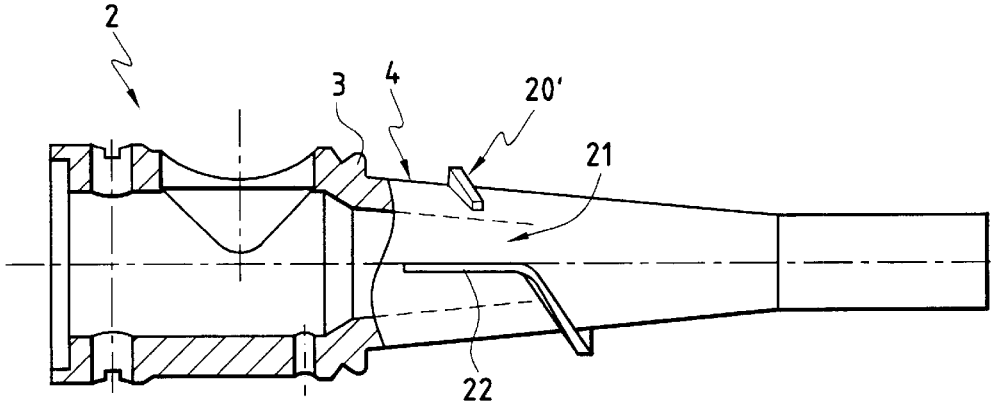
FIG. 3 is a section through a removable nozzle suitable for fitting to a vapor-liquid ejector of the invention.

FIG. 3 shows another variant embodiment of the means fitted to a nozzle 2 for deflecting the liquid. This variant is particularly preferred.

These deflector means are constituted by a washer 20' that is open at 21 and that has a rib 22. Said rib 22 extends along the axis of the nozzle 2 (at the same vertical level as the axis) from the bottom edge of said opening 21. In the variant shown, said open washer 20' is machined in the material of the nozzle 2.

On examining said FIG. 3, it can readily be seen how said open washer 20' imparts turning movement to a fraction of the flow of driven liquid, as described above in the general description of the invention.

Figure 4:
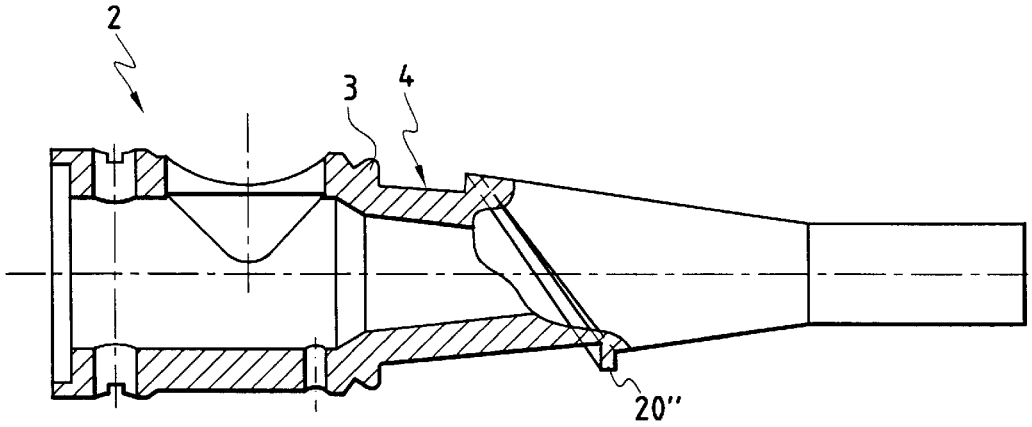
FIG. 4 is a section view of another removable nozzle suitable for fitting to a vapor-liquid ejector of the invention.

FIG. 4 shows another variant of the means on a nozzle 2 for performing the function of a deflector. These means 20" are machined in relief out of the material of said nozzle 2. The profile of the outer surface 4 of said nozzle 2 is thus modified in two ways compared with that of the prior art nozzle shown in FIG. 1, firstly by inclining said outer surface 4 immediately downstream from the shoulder 3, and secondly by providing a portion in relief 20".

It is recalled at this point that 20, 20', and 20" in FIGS. 2, 3, and 4 respectively are merely variant embodiments of means suitable for preforming the deflector function, which means can therefore exist in numerous other forms (and in particular in the form of grooves).

Figure 5A:
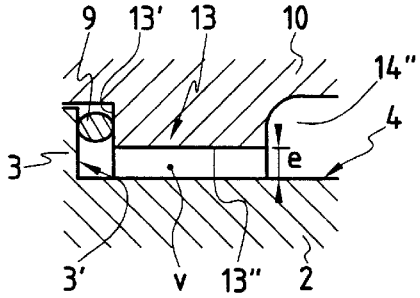
FIGS. 5A to 5E are enlargements of the zone that is sensitive in the context of the present invention (shown in fragmentary section): i.e. the interstitial volume corresponding to assembly clearance for fitting the nozzle in the body of the ejector.

FIG. 5A shows an interstitial volume v that is enlarged in the meaning of the invention without changing its shape compared with the shape shown in FIG. 1 (prior art, no change to the profiles of the facing surfaces 4 and 13").

Figure 5B:
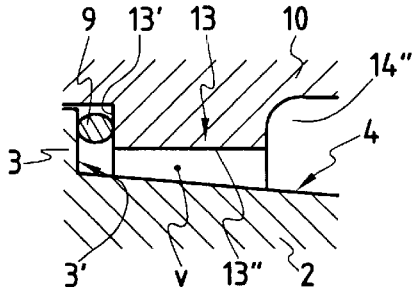

In FIG. 5B, the distance between the facing surfaces 4 and 13" increases going from upstream to downstream because said surface 4 slopes continuously. In this variant, only the profile of the outer surface 4 of the nozzle has been modified.

Figure 5C:
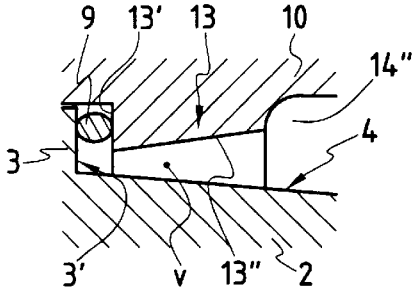

In FIG. 5C, this distance likewise increases continuously but now it does so because of two continuous slopes in opposite directions over the entire length of the volume v of said two surfaces 4 and 13".

Figure 5D:
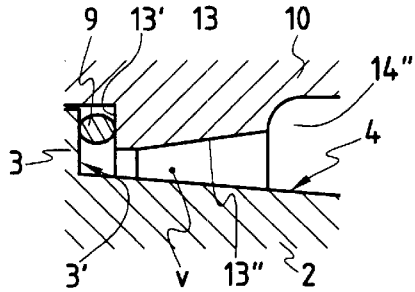

FIG. 5D reproduces the variant shown in FIG. 2. The surface 4 slopes over the entire length of the volume v while the surface 13" slopes only over its downstream major fraction.

Figure 5E:
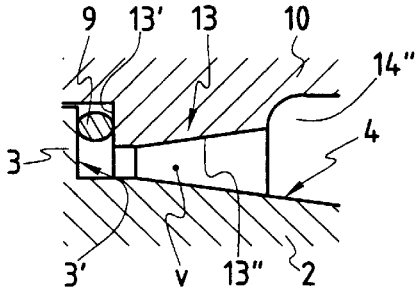

In FIG. 5E, neither of said surfaces 4 and 13" slopes over the entire length of said volume v.

In any event, in FIGS. 5B to 5E, it can be seen that the interstitial volume v is both enlarged and opened relative to the same volume in the prior art (FIG. 1).

What is claimed is:

1. A vapor-liquid (V-L) ejector (1) having a body (10) having a recess (14) that receives a removable nozzle (2), said body (10) of said ejector (1) presenting:

a first duct (11) for feeding said nozzle (2) with vapor (V) which constitutes a driving fluid;

a second duct (12) downstream from said first duct (11) along the axis of said nozzle (2) relative to the flow direction of said vapor (V) and serving to introduce the driven liquid (L) into said recess (14) of said body (10); and between said first and second ducts (11, 12), an internal shoulder (13) against which a shoulder (3) of the body of said nozzle (2) comes into abutment, sealing means (9) being interposed between the facing surfaces (13', 3') of said two shoulders (13, 3) to prevent the driven liquid (L) rising upstream from said sealing means (9); an interstitial volume (v) inherent to said engagement then existing between the outer surface (4) of the body of said nozzle (2) where it extends downstream from the shoulder (3) of said body of said nozzle (2) and the surface (13") of the internal shoulder (13) of the body (10) of the ejector (1) facing said outer surface (4) of the body of said nozzle (2), said interstitial volume (v) extending along the axis of said nozzle (2) over a length that goes from the shoulder (3) of said body of said nozzle (2) to the level where the driven liquid (L) is introduced into said body (10) of said ejector (1) via the second duct (12) and giving said driven liquid (L) access to said sealing means (9);

said ejector (1) being characterized in that:

over its entire length extending along the axis of said nozzle (2), said interstitial volume (v) presents a thickness of not less than 2 mm; and in that said nozzle (2) has means (20, 20', 20") on its outer surface (4) facing said second duct (12) for causing at least a fraction of the flow of driven liquid (L) to be directed upstream towards said sealing means (9) via said interstitial volume (v).

2. The ejector (1) according to claim 1, wherein said interstitial volume (v) is of thickness (e) that is not constant and that increases from upstream to downstream over at least a fraction of its length.

3. The ejector (1) according to claim 2, characterized in that said interstitial volume (v) is of thickness (e) that is not constant and that increases from upstream to downstream over its entire length.

4. The ejector (1) according to claim 2, characterized in that said outer surface (4) of the body of said nozzle (2) as it extends downstream from the shoulder (3) of said body corresponds, at least over a downstream fraction of the length of said interstitial volume (v), to the surface of a truncated cone.

5. The ejector (1) according to claim 4, characterized in that said outer surface (4) of the body of said nozzle (2) as it extends downstream from the shoulder (3) of said body corresponds, over its entire length, to the surface of a truncated cone.

6. The ejector (1) according to claim 4, characterized in that said outer surface (4) of the body of said nozzle (2) is inclined relative to the axis of said nozzle (2) by at least 5° from upstream to downstream.

7. The ejector (1) according to claim 2, characterized in that the surface (13") of said internal shoulder (13) of the body (10) of the ejector (1) facing the outer surface (4) of the body of said nozzle (2) extends from upstream to downstream at least over the downstream fraction of the length of said interstitial annular volume (v) in a flared configuration relative to the axis of said nozzle (2).

8. The ejector (1) according to claim 7, characterized in that the surface (13") of said internal shoulder (13) of the body (10) of the ejector (1) facing the outer surface (4) of the body of said nozzle (2) extends from upstream to downstream over the entire length of said intersticical annular volume (v) in a flared configuration relative to the axis of the said nozzle (2).

9. The ejector (1) according to claim 7, characterized in that the surface (13") of said internal shoulder (13) of the body (10) of the ejector (1) facing the outer surface (4) of the body of said nozzle (2) extends from upstream to downstream, at least over the downstream fraction of the length of said interstitial annular volume (v), in a flared configuration relative to the axis of the said nozzle (2), at an angle that is less than or equal to 5° measured relative to said axis.

10. The ejector (1) according to claim 2, characterized in that:

said outer surface (4) of the body of said nozzle (2) extending downstream from the shoulder (3) of said body corresponds over its entire length to the surface of a truncated cone that slopes relative to the axis of said nozzle (2) from upstream to downstream; while the surface (13") of said internal shoulder (13) of the body (10) of the ejector (1) facing said outer surface (4) of the body of said nozzle (2) extends from upstream to downstream over a downstream major fraction of the length of said interstitial volume (v) flaring relative to the axis of said nozzle (2).

11. The ejector (1) according to claim 10, characterized in that said outer surface (4) corresponds to the surface of a truncated cone that slopes at an angle of at least 5°.

12. The ejector (1) according to claim 10, characterized in that said surface (13") of said internal shoulder (13) extends flaring at an angle that is less than or equal to 5°.

13. The ejector (1) according to claim 1, characterized in that said means for directing at least a fraction of the flow of driven liquid (L) towards said sealing means (9) comprise means (20) that are fitted onto the outer surface (4) of the nozzle (2) or that exist by being machined in the material of said nozzle (2) to form portions that are recessed or that are in relief (20', 20").

14. The ejector (1) according to claim 1, characterized in that said means for directing at least a fraction of the flow of the driven liquid (L) towards said sealing means (9) comprise at least a portion of a washer that is secured to the outer surface (4) of the nozzle (2), with the bottom thereof being situated on the axis of the second duct (12) and with the top thereof being close to the inlet of said annular interstitial volume (v).

15. The ejector (1) according to claim 14, characterized in that said means for directing at least a fraction of the flow of driven liquid (L) towards said sealing means (9) consist in an elliptical washer (2) inclined relative to the axis of the nozzle (2).

16. The ejector according to claim 14, characterized in that said means for directing at least a fraction of the flow of driven liquid (L) towards said sealing means (9) consist in an open washer (20') sloping relative to the axis of the nozzle (2) having the bottom edge of the opening (21) extended level with and along said axis of the nozzle (2) by means of a rib (22) which extends towards said sealing means (9).

17. A nozzle (2) for constituting a removable nozzle of a vapor-liquid (V-L) ejector (1), the nozzle being characterized in that it includes means (20, 20', 20") on its outer surface (4) for directing in an upstream direction at least a fraction of the flow of the liquid (L) driven by said ejector.

18. The nozzle (2) according to claim 17, having a converging-diverging profile, wherein said means (20' 20") are machined in the material of said nozzle and are positioned on the outer surface of the converging portion.

19. The ejector (1) according to claim 1, wherein said interstitial volume (v) has a constant thickness.

20. The nozzle (2) according to claim 17, wherein the means for directing the flow in an upstream direction as formed in recess on the outer surface (4) of the nozzle (2).

21. The nozzle (2) according to claim 17, wherein the means for directing the flow in an upstream direction are formed in relief on the outer surface (4) of the nozzle (2).

22. The nozzle (2) according to claim 17, having a converging-diverging profile, wherein said means includes a piece (20) that is fitted to the nozzle and positioned on the outer surface floor of the converging portion.

* * * * *